US005451026A

United States Patent [19]

Smith

[11] Patent Number: 5,451,026

[45] Date of Patent: Sep. 19, 1995

[54] PICTURE FRAME STAND

[76] Inventor: Howard Smith, 528 6th Ave. North, Glasgow, Mont. 59230

[21] Appl. No.: 283,692

[22] Filed: Aug. 1, 1994

[51] Int. Cl.[6] ..... A47G 1/16

[52] U.S. Cl. ..... 248/469; 40/152.1

[58] Field of Search ..... 248/469, 471, 472, 473, 248/455, 457, 454, 470, 152, 160; 40/152.1

[56] References Cited

U.S. PATENT DOCUMENTS

| | | | |
|---|---|---|---|
| D. 274,682 | 7/1984 | Segel | D6/310 |
| 3,928,931 | 12/1975 | Slemmons | 40/152.1 |
| 4,033,058 | 7/1977 | Lyman | 40/97 |
| 4,058,283 | 11/1977 | Frechtman | 248/441 D |
| 4,229,892 | 10/1980 | Hueter et al. | 40/152.1 |
| 4,738,041 | 4/1988 | Drueck, Jr. | 40/155 |
| 5,056,250 | 10/1991 | Weissleder et al. | 40/152.1 X |
| 5,058,297 | 10/1991 | McGinnis | 40/155 |
| 5,222,315 | 6/1993 | Lovison | 40/159 |
| 5,253,840 | 10/1993 | Sheremetta | 248/455 X |

FOREIGN PATENT DOCUMENTS

| | | | |
|---|---|---|---|
| 1216525 | 11/1959 | France | 248/471 |

*Primary Examiner*—Ramon O. Ramirez
*Attorney, Agent, or Firm*—Kevin Sembrat

[57] ABSTRACT

A picture frame stand is provided for supporting framed articles of varying sizes on a horizontal support surface such as a countertop or a desk. A rigid base member and a rigid upright member is connected to a flexible upright member to form a stand of essentially triangular shape. The stand operates by pressing the flexible upright member toward the rigid upright member, thereby urging the ends of the flexible upright member closer together, in order to position the ends against a top and a bottom shoulder of the picture frame, and subsequently releasing the flexible upright member which urges the ends against the top and bottom shoulder. In this position, the picture frame stand is detachably mounted with the base member extending outwardly away from the picture frame, thereby forming a tripod base with a bottom edge of the picture frame. Therefore, pictures previously hanging on walls may easily be converted for placement on a countertop or desk.

18 Claims, 3 Drawing Sheets

PICTURE FRAME STAND

BACKGROUND OF THE INVENTION

1. Field of the Invention

The present invention relates generally to picture frame stands and, more particularly, to picture frame stands that are detachably mountable to a picture and frame combination for easy conversion from a wall-hanging picture frame to a countertop picture frame.

2. Description of the Related Art

In the related art, framed pictures such as photographs and paintings are commonly displayed being hung on a wall. These framed pictures commonly hang on a wall with a combination hook and cable loop means or other hanging means. However, these common hanging means provide no versatility to easily convert the hanging framed picture for placement on a horizontal support surface such as a countertop or desk. Typically, a convertible frame is utilized, whereby the frame is convertible between hanging on a wall and standing on a horizontal support surface. For hanging a picture on a wall with this type of convertible frame, the picture frame usually includes a heavy paper frame backing sheet having a small, semi-circular tab die-cut therein with a hole in the center thereof. The semi-circular tab is bent out from the plane of the backing sheet and the hole therein is hooked over a small nail driven into a wall. In such a case, the frame essentially lies flat against the wall.

On the other hand, for mounting on a shelf, a small fold-out easel is usually die-cut from the heavy backing sheet. To assemble, the easel leg is bent perpendicular to the original plane of the backing sheet and a small locking tab secures the leg in this position. The frame can then be positioned on a shelf in a stable position with a slight slope for easy viewing. However, the convertible frames are not easily convertible from hanging on a wall to placement on a horizontal support surface, as significant assembly of the backing sheet is required for the conversion. Further, using a particular convertible frame with a picture limits the use of another frame which may otherwise be more aesthetically preferable for use with that particular picture.

Alternatively, various types of stands presently exist for placing a previously hanging framed picture on a horizontal support surface. For example, U.S. Pat. No. 4,058,283, issued in the name of Frechtman, discloses a convertible picture frame stand having a more secure easel-type stand which establishes an appropriate display angle for the picture. The stand rests on a display surface and includes an inclined segment to accommodate the lower edge of the framed article in a firm and releasably secure position. However, the Frechtman reference, with numerous parts including a hanging bracket, is expensive to manufacture and difficult to attach to the frame. Further, a portion of the Frechtman reference is visible when it is displaying a framed picture, thereby detracting from the aesthetic and artistic beauty of the picture and the frame.

Consequently, a need has been felt for providing a stand for a framed picture, whereby the stand provides the versatility of easy conversion from hanging the framed picture on a wall to placing the framed picture on a horizontal support surface such as a countertop or desk, and wherein the stand is shielded from view by the framed picture while the stand provides an appropriate display angle for the framed picture when placed on the horizontal support surface.

SUMMARY OF THE INVENTION

It is therefore an object of the present invention to provide an improved stand for a framed picture stand that easily converts a framed picture hanging on a wall for placement on a horizontal support surface such as a countertop or desk.

It is a further object of the present invention to provide an improved stand for a framed picture, wherein the stand is shielded from view by the framed picture while the stand provides an appropriate display angle for the framed picture when placed on the horizontal support surface.

It is a feature of the present invention to have a triangular shape formed by two rigid members and one flexible member which flexes for installation between the top and bottom shoulders of the picture frame.

Briefly described according to one embodiment of the present invention, a picture frame stand is provided for supporting framed articles of varying sizes on a horizontal support surface such as a countertop or a desk. A rigid base member and a rigid upright member is connected to a flexible upright member to form a stand of essentially triangular shape. The stand operates by pressing the flexible upright member toward the rigid upright member, thereby urging the ends of the flexible upright member closer together, in order to position the ends against a top and a bottom shoulder of the picture frame, and subsequently releasing the flexible upright member which urges the ends against the top and bottom shoulder. In this position, the picture frame stand is detachably mounted with the base member extending outwardly away from the picture frame, thereby forming a tripod base with a bottom edge of the picture frame. In this manner, pictures previously hanging on walls may easily be converted for placement on a countertop or desk.

In accordance with a preferred embodiment, a picture frame stand is provided for supporting an article having a frame with a top shoulder, a bottom shoulder and a bottom edge, wherein the picture frame stand comprises: a base element; a first upright element; and a second upright element, wherein the base element and the first upright element and the second upright element are connected together to form a triangular shape that is detachably mounted to the frame by pressing a first end of the first upright element against the top shoulder of the frame and pressing a first end of the second upright element against a bottom shoulder of the frame, thereby to extend the base element outwardly away from the article having the frame, in order that the frame is supported on a horizontal support surface against the bottom edge of the frame and against the second end of the first upright element.

An advantage of the present invention is that a framed picture that previously hung on a wall may be displayed on a horizontal support surface.

Another advantage of the present invention is that an alternative to a customized and expensive stand is provided.

Another advantage of the present invention is that a plurality of stands may be used with a single framed picture to provide optimum support.

Another advantage of the present invention is that it adapts to most frame styles.

A further advantage of the present invention is that it takes up little extra space and is quickly and easily detachably mounted to the framed picture.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Detailed Description of the Figures

Figure 1:
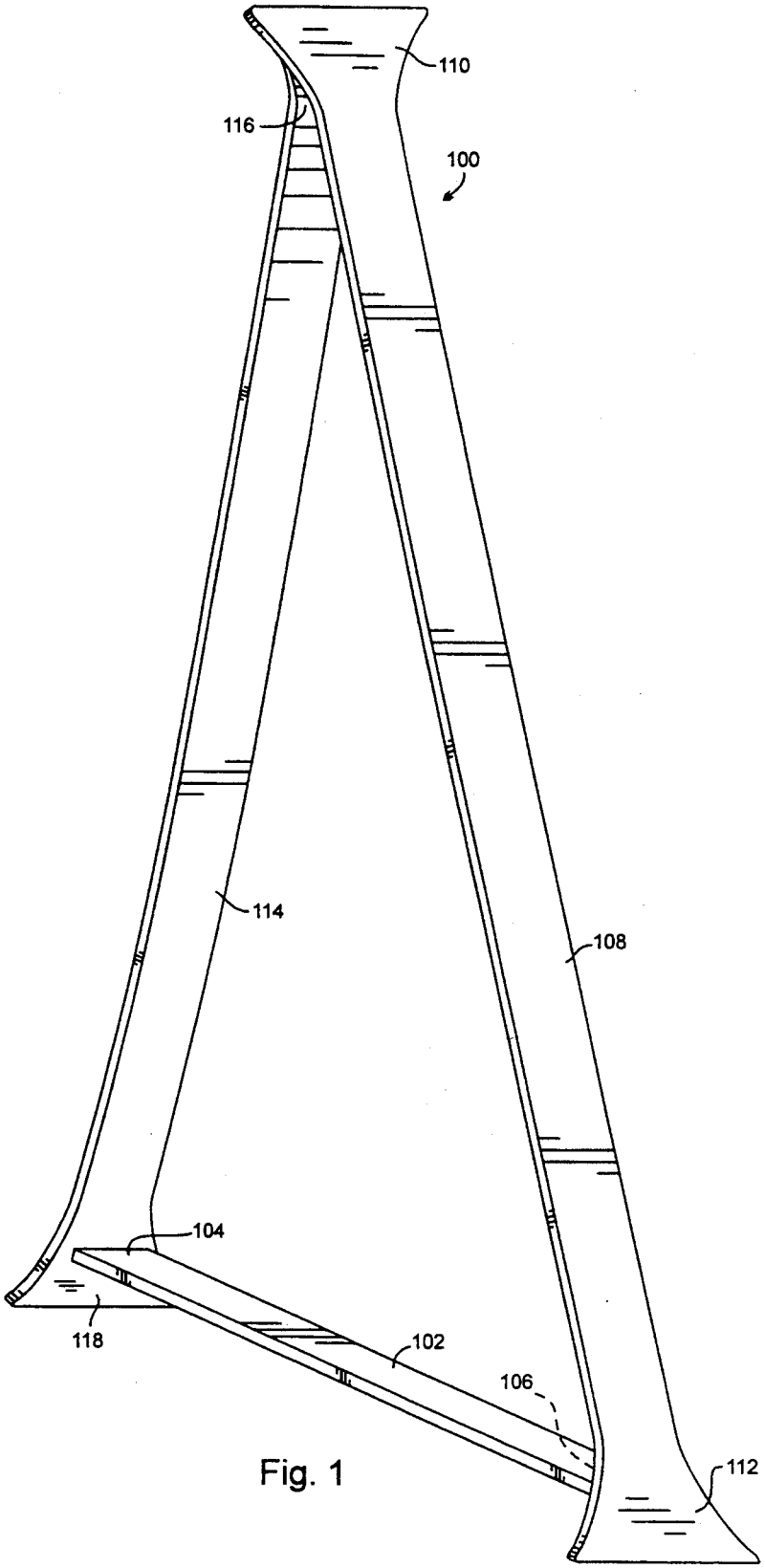
FIG. 1 is a left and rear perspective view of a preferred embodiment of the present invention.

Referring now to FIG. 1, a picture frame stand 100 is shown, according to the present invention. A base member 102 has ends 104, 106. A first upright member 108 has ends 110, 112. A second upright member 114 has ends 116, 118. The base member 102, the first upright member 108 and the second upright member 114 are attached with attachment means, preferably glue or spot welds, at the ends thereof, thereby to form the three sides of a triangular shape. In accordance with a preferred embodiment of the present invention, the second upright member 114 is bowed inwardly toward the first upright member 108, thereby to tension the ends 116, 118 away from each other.

The end 106 is attached to the end 112 in a manner to permit the end 112 to rest on the horizontal support surface. Similarly, the end 104 is attached to the end 118 in a manner to permit the end 118 to rest on a horizontal support surface when not mounted to a framed picture, and to rest against a bottom shoulder of the framed picture when detachably mounted thereupon (see FIG. 3).

The first upright member 108 extends upwardly and is angled to bring the end 110 into contact with the end 116 for attachment thereto. The end 116 is attached to the end 110 in a manner to permit the end 110 to rest against a bottom shoulder of the framed picture when detachably mounted thereupon (see FIG. 3).

A preferred embodiment of the present invention has the base member 102 and the first upright member 108 constructed of a rigid material, such as metal, wood or plastic, thereby to provide support against the weight of the framed picture which is displayed on a horizontal support surface (see FIG. 3). A preferred embodiment of the present invention has the ends 110, 112, 116, 118 flanged outwardly to provide additional stability for mounting to the framed picture and for standing.

Figure 2:
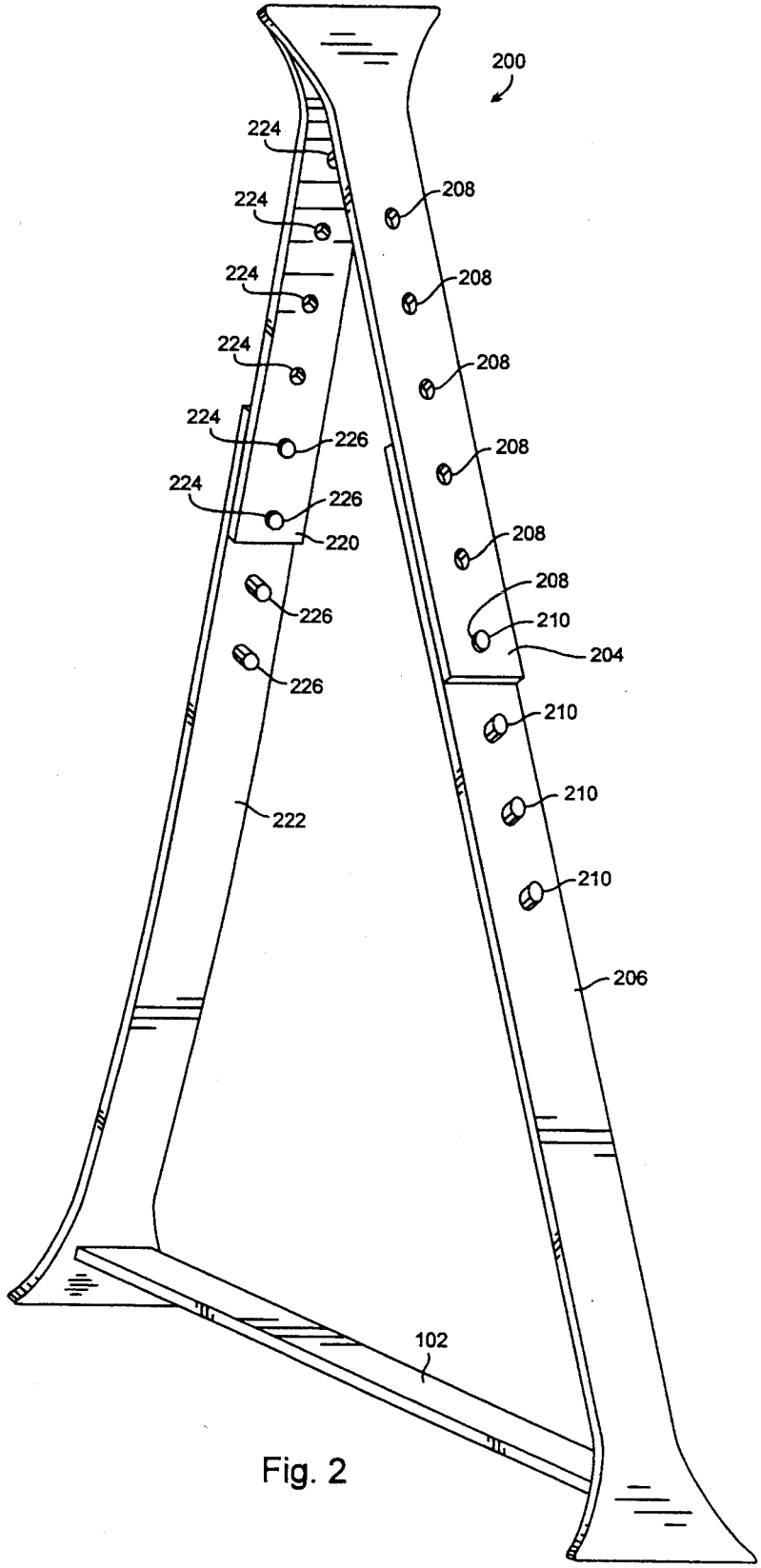
FIG. 2 is a left and rear perspective view of a preferred embodiment of the present invention with an adjustable upright member.

FIG. 2 shows an adjustable picture frame stand 200 that is adjustable to various heights to accommodate various sizes of framed pictures. The base member 102 forms a first side of a triangle. A second side of the triangle is adjustable and comprised of a first adjustable member 204 which is adjustably coupled to a second adjustable member 206 in a manner similar to that manner found on baseball caps which are adjustable for head size. A third side of the triangle is adjustable and comprised of a third adjustable member 220 which is adjustably coupled to a fourth adjustable member 222 in a manner similar to that of members 204, 206. Specifically, the first adjustable member 204 and the third adjustable member 220 respectively defines a plurality of orifices 208,224 which receive a plurality of studs 210, 226 that respectively extend outwardly away from the second adjustable member 206 and the fourth adjustable member 222. As is well-known in the art, the plurality of orifices 208,224 corresponds to the positioning of the plurality of studs 210, 226, thereby to be detachably fitted over the plurality of studs 210 in one of a plurality of positions, thereby securing the first adjustable member 204 in a fixed position relative to the second adjustable member 206 and securing the third adjustable member 220 in a fixed position relative to the fourth adjustable member 222.

Another preferred embodiment of the present invention slides the first adjustable member 204 over the second adjustable member 206 in a telescopic manner, and is lockable in a manner well-known in the art into various positions relative to the second adjustable member 206.

Another preferred embodiment of the present invention slides the third adjustable member 220 over the fourth adjustable member 222 in a telescopic manner, and is lockable in a manner well-known in the art into various positions relative to the second adjustable member 222.

Operation of the Preferred Embodiment

Figure 3A:
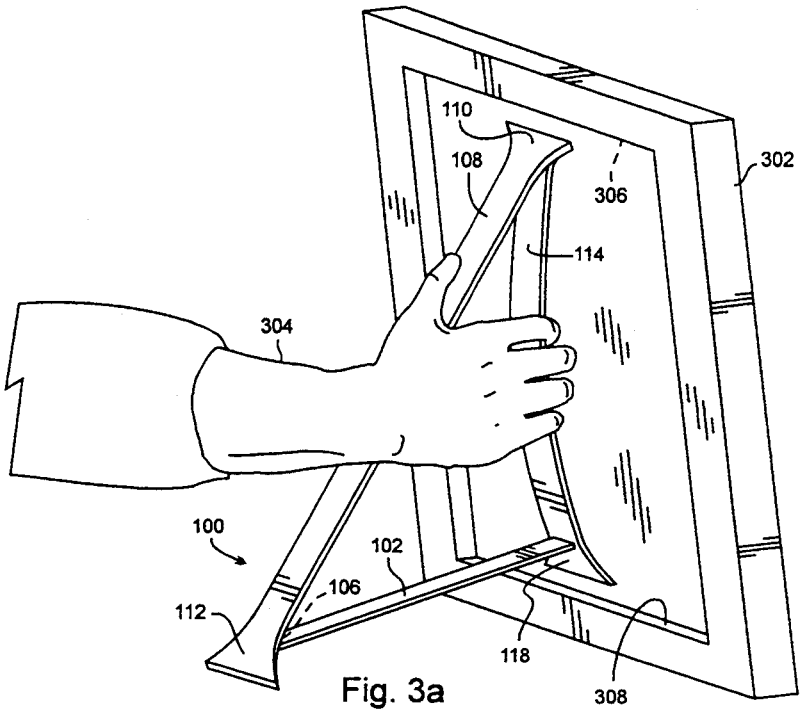
FIG. 3*a* is a right and rear elevational view of a user's hand flexing a flexible member of the present invention prior to positioning the end of the flexible member against a top and a bottom shoulder of a picture frame, according to a preferred embodiment of the present invention.

FIG. 3*a* shows a right and rear elevational view of the picture frame stand 100 of FIG. 1 being mounted within a picture frame 302. A user's hand 304 flexes the flexible second upright member 114 of the present invention by urging the portion located between the ends 110, 118 partially toward the first upright member 108. Although a preferred embodiment of the first upright member 108 and the base member 102 is a rigid material such as wood or plastic, one skilled in the art will recognize that some flexibility will exist in the members 102, 108 and at the joint where the ends 106, 112 are attached. Consequently, urging the portion located between the ends 110, 118 partially toward the first upright member 108 will urge the ends 110, 118 closer toward each other, thereby minimizing the distance between the ends 110, 118 for insertion of the ends 110, 118 between a top shoulder 306 and a bottom shoulder 308 of the picture frame 302. Upon releasing the user's hand 304, the second upright member 114 will urge the ends 110, 118 against the top shoulder 306 and the bottom shoulder 308, thereby securing the picture frame stand 100 in an easily detached mount to the picture frame 302, with the base member 102 extending outwardly away from the picture frame 302.

Figure 3B:
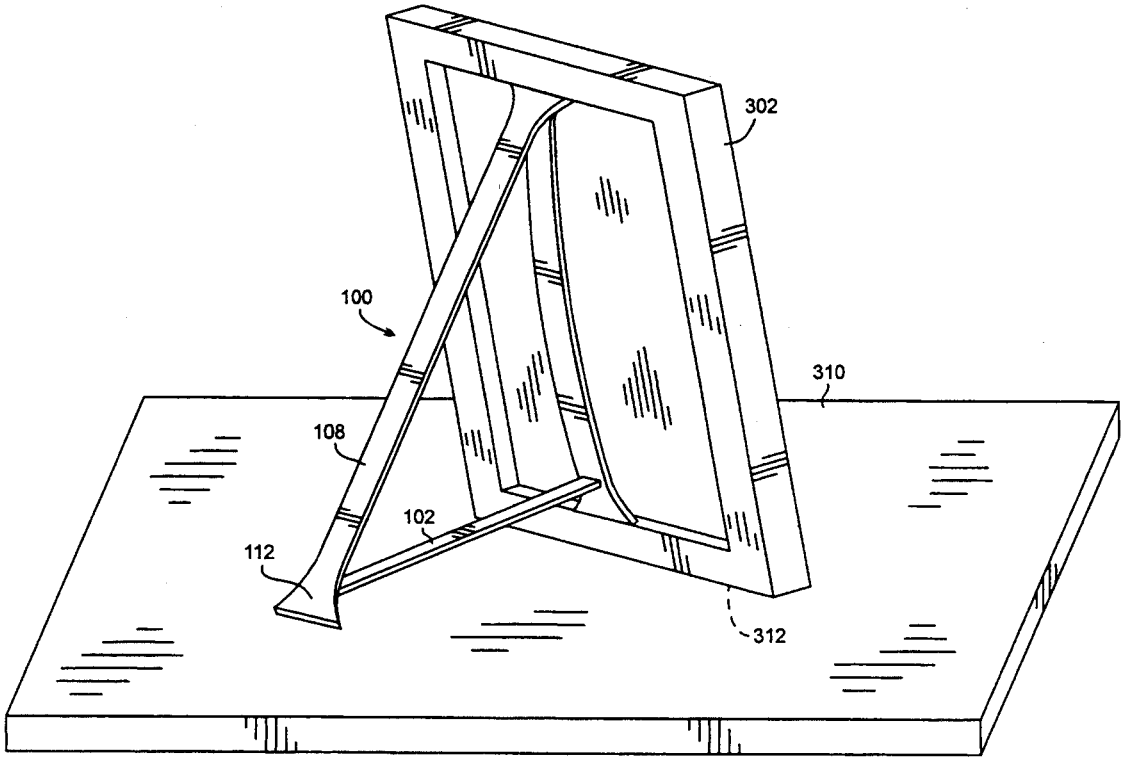
FIG. 3*b* is a right and rear elevational view of the present invention mounted to a framed picture, thereby providing an appropriate display angle of the framed picture on a horizontal support surface.

FIG. 3*b* shows the picture frame stand 100 mounted within a picture frame 302 and resting on a horizontal support surface 310. The picture frame 302 is supported by resting a bottom edge 312 on the horizontal support surface 310 when the end 112 rests on the horizontal support surface 310, similar to that of a tripod. Various lengths of the base member 102 and of the first upright member 108 will provide various display angles of the picture frame 302 on the horizontal support surface 310. One skilled in the art will recognize that more than one picture frame stand 100 may be mounted side-by-side within the picture frame 302 for additional support of a heavier frame.

The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A picture frame stand for supporting an article having a frame with a top shoulder, a bottom shoulder and a bottom edge, wherein the picture frame stand comprises:

a base element;

a first upright element; and a second upright element, wherein said base element and said first upright element and said second upright element are connected together to form a triangular shape that is detachably mounted to said frame by pressing a first end of said first upright element against said top shoulder of said frame and pressing a first end of said second upright element against a bottom shoulder of said frame, thereby to extend said base element outwardly away from said article having said frame, in order that said frame is supported on a horizontal support surface against said bottom edge of said frame and against a second end of said first upright element.

2. The device according to claim 1, wherein said base element and said first upright element is each constructed of a rigid material.

3. The device according to claim 1, wherein said second upright element is constructed of a flexible material.

4. The device according to claim 3, wherein said second upright element is bowed toward said first upright element, thereby to urge said first end of said first upright element away from said first end of said second upright element.

5. The device according to claim 2, wherein said rigid material is wood.

6. The device according to claim 2, wherein said rigid material is plastic.

7. The device according to claim 3, wherein said rigid material is wood.

8. The device according to claim 3, wherein said rigid material is plastic.

9. A device for supporting an article having a frame with a top shoulder, a bottom shoulder and a bottom edge, wherein the device comprises:

a base element having a first end and a second end;

a first upright element having a first end and a second end, wherein a standing edge is formed by connecting said first end of said first upright element to said first end of said base element, thereby to form an acute angle between said first upright element and said base element; and a second upright element having a first end and a second end, wherein a top edge is formed by connecting said first end of said second upright element to said second end of said first upright element, thereby to form an acute angle between said second upright element and said first upright element, and a front edge is formed by connecting said second end of said second upright element to said second end of said base element, thereby to form an acute angle between said second upright element and said base element, and thereby to form a triangular shape with said base element, said first upright element, and said second upright element, whereby said device detachably mounts to said frame by pressing said top edge against said top shoulder and pressing said bottom edge against said bottom shoulder, thereby to juxtapose said standing edge away from said frame, against which said frame is supported in a standing position when said bottom edge of said frame and said standing edge contacts a horizontal support surface.

10. The device according to claim 9, wherein said base element and said first upright element is each constructed of a rigid material.

11. The device according to claim 9, wherein said second upright element is constructed of a flexible material.

12. The device according to claim 11, wherein said second upright element is bowed toward said first upright element, thereby to urge said top edge away from said front edge.

13. The device according to claim 11, wherein said rigid material is wood.

14. The device according to claim 11, wherein said rigid material is plastic.

15. The device according to claim 2, wherein said rigid material is metal.

16. The device according to claim 11, wherein said rigid material is metal.

17. The device according to claim 1, wherein said first upright element and said second upright element is adjustable in height.

18. The device according to claim 9, wherein said first upright element and said second upright element is adjustable in height.

* * * * *